US007890033B2

(12) United States Patent
Murayama et al.

(10) Patent No.: US 7,890,033 B2
(45) Date of Patent: Feb. 15, 2011

(54) DEVELOPING DEVICE, PROCESS UNIT, AND IMAGE FORMING APPARATUS WHICH PREVENTS INGRASS OF THE DEVELOPING AGENT IN THE VICINITY OF THE DEVELOPING MEMBER

(75) Inventors: Shin Murayama, Hyogo (JP); Shuuichi Nakagawa, Osaka (JP); Ryuji Inoue, Hyogo (JP); Shintaro Yamada, Toyko (JP)

(73) Assignee: Ricoh Company, Ltd., Tokyo (JP)

( * ) Notice: Subject to any disclaimer, the term of this patent is extended or adjusted under 35 U.S.C. 154(b) by 506 days.

(21) Appl. No.: 11/965,198

(22) Filed: Dec. 27, 2007

(65) Prior Publication Data

US 2008/0175626 A1 Jul. 24, 2008

(30) Foreign Application Priority Data

Jan. 18, 2007 (JP) ..... 2007-008671

(51) Int. Cl.
*G03G 15/08* (2006.01)

(52) U.S. Cl. ..... 399/284

(58) Field of Classification Search ..... 399/254, 399/281, 284, 258, 274, 27, 29
See application file for complete search history.

(56) References Cited

U.S. PATENT DOCUMENTS

2001/0005458 A1* 6/2001 Yamanaka et al. ..... 399/43
2003/0118374 A1* 6/2003 Eun et al. ..... 399/252
2006/0280529 A1 12/2006 Nakagawa et al.
2007/0003327 A1* 1/2007 Fish et al. ..... 399/281
2007/0104523 A1 5/2007 Yoshida et al.
2007/0189812 A1 8/2007 Murayama et al.
2009/0047036 A1 2/2009 Hori et al.

FOREIGN PATENT DOCUMENTS

JP 2001-194883 7/2001

OTHER PUBLICATIONS

U.S. Appl. No. 12/179,038, filed Jul. 24, 2008, Murayama, et al.

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P.

(57) ABSTRACT

A developing device that prevents the formation of agglomerated masses of developing agent in the bottom of the developing agent housing chamber near the developing roller and the supply roller, and that maintains the fluidity of the developing agent in the bottom of the developing agent housing chamber, while minimizing any increase in size of the developing device. The developing device includes an agitator disposed higher than the developing roller, the regulating blade, and the supply roller, and that agitates a non-magnetic one component developing agent within the developing agent housing chamber; and a developing agent ingress prevention member disposed higher than the supply roller, and lower than the agitator, and the side surface or edge portion of the developing agent ingress prevention member near the developing roller is higher than the topmost point of the supply roller, and lower than the lowermost point of the regulating nip formed by the contact of the developing roller and the regulating blade.

12 Claims, 9 Drawing Sheets

FIG. 5

| DISTANCE BETWEEN THE PROTECTION MEMBER AND THE SUPPLY ROLLER [mm] | TONER AGGLOMERATION IN THE GAP BETWEEN THE SUPPLY ROLLER AND THE OPPOSING SIDE WALL |
|---|---|
| 0 | YES |
| 1 | NO |
| 2 | NO |
| 3 | NO |
| 4 | NO |
| 5 | YES |

DEVELOPING DEVICE, PROCESS UNIT, AND IMAGE FORMING APPARATUS WHICH PREVENTS INGRASS OF THE DEVELOPING AGENT IN THE VICINITY OF THE DEVELOPING MEMBER

BACKGROUND OF THE INVENTION

1. Field of the Invention

The present invention relates to a developing device, in which electrostatic latent images on the image carrier are developed using a non-magnetic one component developing agent, a process unit, and an image forming apparatus.

2. Description of the Related Art

In a developing device of this type, if a large quantity of toner as developing agent accumulates on the developing agent supply member, such as a supply roller or the like, various types of problems can occur due to agglomeration of the toner as a result of the pressure due to the self weight. Therefore, normally a second housing chamber that houses a large quantity of toner is provided to the side of and separate from the developing agent supply member or a first housing chamber that houses toner. By gradually supplying an appropriate amount of toner from the second housing chamber to the first housing chamber, agglomeration of toner around the toner supply member is reduced. In the second housing chamber, which houses a large quantity of toner, agglomeration is reduced by mixing the toner with air by agitating the toner using an agitating rotating member such as an agitator or the like.

On the other hand, in color image forming apparatus in recent years, in order to achieve high print speeds, the so-called tandem configuration has been widely adopted. In the tandem configuration, a plurality of a combination of latent image carrier, such as a photosensitive member or the like, and a developing device for developing the latent image on the surfaces of the photosensitive member is disposed in a line, and single color images each with mutually different colors developed on the photosensitive members are transferred onto an intermediate transfer belt or similar, and superimposed. Then, by transferring this superimposed image, multi-color images such as full color images are formed. In this configuration, the combinations of latent image carrier and developing device are aligned in the horizontal direction. Therefore, if a second housing chamber disposed to the side of the first housing chamber is used, it is necessary to provide a considerable amount of space in the horizontal direction. As a result, the apparatus becomes larger.

If a developing device that is long in the vertical direction, as for example the device disclosed in Japanese Patent Application Laid-open No. 2001-194883, is used, it is possible to minimize the increase in size of this type of apparatus. Specifically, on top of the first housing chamber, which includes a supply roller as toner and developing agent supply member, there is a hopper as the second housing member. The toner housed within the hopper drops into the first housing chamber via a connecting aperture provided between the hopper and the first housing chamber. Within the first housing member, the supply roller, which carries toner on its peripheral surface, is rotated, to supply the toner on the supply roller to a developing roller as developing agent carrier. In this configuration, the second housing chamber, which takes up a particularly large amount of space, is provided above the first housing chamber within the developing device. As a result, overall the developing device has a shape that is tall and takes up more space in the vertical direction than in the horizontal direction, so it is possible to minimize the increase of space in the horizontal direction. However, in the developing device according to this configuration, toner that drops from the hopper into the first housing chamber accumulates in large quantities on the supply roller, which is the developing agent supply member. Then the toner agglomerates due to the pressure of the self weight, the torque of the supply roller increases, image density unevenness is caused, and wear of the supply roller is significantly increased.

According to tests carried out by the four inventors, agglomeration of toner within tall developing devices is particularly significant between the supply roller and an opposing side wall surface, of a plurality of side walls of the first housing chamber, when the intervening gap is small relative to the peripheral surface of the supply roller. Specifically, in the developing device with a tall configuration as disclosed in Japanese Patent Application Laid-open No. 2001-194883, after the toner that has accumulated above the supply roller has been carried on the surface of the supply roller, the toner is transported by the rotation to the supply position, which is the portion in contact with or in opposition to the developing roller. Then, the surface of the supply roller that has passed the supply position is again brought into the contact position with the accumulated toner by the rotation. In the space around the area of the supply roller from the supply position to the contact position, the toner moves in the direction of the gravitational force due to self-weight or spreads to the side, and is unable to make good contact with the supply roller, and remains accumulated there. Therefore, if the space referred to above is provided, the amount of wasted toner that is not used in developing increases. Therefore, in tall developing devices, preferably the facing side wall of the first housing chamber in opposition to the area of the supply roller from the supply position to the contact position is brought closer to the supply roller so that waste of toner does not occur.

The developing device disclosed in Japanese Patent Application 2001-194883, and the tall developing device used in the tests by the four inventors of the present invention, were configured as follows. The pressure of the toner that drops from the hopper into the first housing chamber and accumulates on the supply roller increases due to the increase in amount accumulated, so after being pressurized by the toner from the hopper, the toner enters the gap between the supply roller and the opposing side wall of the first housing chamber. The movement of the toner that enters the small gap is restricted, so it is difficult to escape from the gap. On the one hand, toner accumulated on the supply roller can easily enter the gap, so the pressure of the toner within the gap gradually increases, and eventually becomes an agglomerated mass. The torque of the supply roller is increased by the pressure of the agglomerated mass against the supply roller, so image density unevenness becomes worse, and wear of the supply roller occurs.

In recent years the use of toner containing wax within the particles in order to achieve oil-less fixing and low temperature fixing has increased, so these problems can easily arise. The toner is comparatively soft, and the adhesive forces between particles are comparatively large, so agglomerated masses are easily formed.

SUMMARY OF THE INVENTION

With the foregoing background in view, it is an object of the present invention to provide a developing device for which good images can be obtained, by maintaining the fluidity of the developing agent in the lower portion of the developing agent housing chamber. The developing device is capable of minimizing the increase in torque of the supply roller, the image density unevenness, and the wear of the supply roller, while minimizing the increase in size of the apparatus. At the same time the formation of agglomerated masses of developing agent in the lower portion of the developing agent housing chamber near the developing roller and supply roller is prevented.

In an aspect of the present invention, a developing device comprises a developing agent housing chamber which houses a non-magnetic one component developing agent, and which extends in a vertical direction, and has an aperture, in a lower portion thereof, that is in opposition to an image carrier that forms an electrostatic latent image; a developing roller which is provided in the aperture and whose peripheral surface is partly exposed from the aperture to form a developing portion with the image carrier, and which carries the non-magnetic one component developing agent on the surface of the developing roller and transports the developing agent by rotation from the developing agent housing chamber to the developing portion, in order to develop on the developing portion, the electrostatic latent image of the image carrier; a regulating blade, which is disposed higher than the center of rotation of the developing roller and is disposed to contact the surface of the developing roller in the vicinity of the aperture on an upstream side of the developing portion, in a transport direction of the developing roller, and which regulates a thickness of the non-magnetic one component developing agent transported on the developing roller; a supply roller which is disposed within the developing agent housing chamber to pressure-contact the developing roller on the upstream side with respect to the regulating blade in the transport direction of the developing roller, and which supplies the non-magnetic one component developing agent within the developing agent housing chamber to the surface of the developing roller; an agitator which is disposed higher than the developing roller, the regulating blade, and the supply roller, and which agitates the non-magnetic one component developing agent within the developing agent housing chamber; and a developing agent ingress prevention member disposed higher than the supply roller, and lower than the agitator. A side surface or edge portion of the developing agent ingress prevention member in the vicinity of the developing roller is higher than the topmost point of the supply roller, and lower than the lowermost point of a regulating nip formed by the contact of the developing roller and the regulating blade.

In another aspect of the present invention, a process unit in an image forming apparatus having a latent image carrier that carries a latent image and a developing device that develops the latent image on the latent image carrier. The process unit comprises at least the latent image carrier and developing device held in a supporting member to be inserted into and removed from a main body of the image forming apparatus. The developing device comprises a developing agent housing chamber which houses a non-magnetic one component developing agent, and which extends in a vertical direction, and has an aperture, in a lower portion thereof, that is in opposition to an image carrier that forms an electrostatic latent image; a developing roller which is provided in the aperture and whose peripheral surface is partly exposed from the aperture to form a developing portion with the image carrier, and which carries the non-magnetic one component developing agent on the surface of the developing roller and transports the developing agent by rotation from the developing agent housing chamber to the developing portion, in order to develop on the developing portion, the electrostatic latent image of the image carrier; a regulating blade, which is disposed higher than the center of rotation of the developing roller and is disposed to contact the surface of the developing roller in the vicinity of the aperture on an upstream side of the developing portion, in a transport direction of the developing roller, and which regulates a thickness of the non-magnetic one component developing agent transported on the developing roller; a supply roller which is disposed within the developing agent housing chamber to pressure-contact the developing roller on the upstream side with respect to the regulating blade in the transport direction of the developing roller, and which supplies the non-magnetic one component developing agent within the developing agent housing chamber to the surface of the developing roller; an agitator which is disposed higher than the developing roller, the regulating blade, and the supply roller, and which agitates the non-magnetic one component developing agent within the developing agent housing chamber; and a developing agent ingress prevention member disposed higher than the supply roller, and lower than the agitator. A side surface or edge portion of the developing agent ingress prevention member in the vicinity of the developing roller is higher than the topmost point of the supply roller, and lower than the lowermost point of a regulating nip formed by the contact of the developing roller and the regulating blade.

In another aspect of the present invention, an image forming apparatus comprises a latent image carrier that carries a latent image; and a developing device that develops a latent image on the latent image carrier. The developing device comprises a developing agent housing chamber which houses a non-magnetic one component developing agent, and which extends in a vertical direction, and has an aperture, in a lower portion thereof, that is in opposition to an image carrier that forms an electrostatic latent image; a developing roller which is provided in the aperture and whose peripheral surface is partly exposed from the aperture to form a developing portion with the image carrier, and which carries the non-magnetic one component developing agent on the surface of the developing roller and transports the developing agent by rotation from the developing agent housing chamber to the developing portion, in order to develop on the developing portion, the electrostatic latent image of the image carrier; a regulating blade, which is disposed higher than the center of rotation of the developing roller and is disposed to contact the surface of the developing roller in the vicinity of the aperture on an upstream side of the developing portion, in a transport direction of the developing roller, and which regulates a thickness of the non-magnetic one component developing agent transported on the developing roller; a supply roller which is disposed within the developing agent housing chamber to pressure-contact the developing roller on the upstream side with respect to the regulating blade in the transport direction of the developing roller, and which supplies the non-magnetic one component developing agent within the developing agent housing chamber to the surface of the developing roller; an agitator which is disposed higher than the developing roller, the regulating blade, and the supply roller, and which agitates the non-magnetic one component developing agent within the developing agent housing chamber; and a developing agent ingress prevention member disposed higher than the supply roller, and lower than the agitator. A side surface or edge portion of the developing agent ingress prevention member in the vicinity of the developing roller is higher than the topmost point of the supply roller, and lower than the lowermost point of a regulating nip formed by the contact of the developing roller and the regulating blade.

BRIEF DESCRIPTION OF THE DRAWINGS

The above and other objects, features, and advantages of the present invention will become more apparent from the following detailed description taken with the accompanying drawings in which:

FIG. 5 is a table showing the test results for the present invention;

DESCRIPTION OF THE PREFERRED EMBODIMENTS

A more detailed explanation is provided below in reference to drawings according to the present invention.

The following in an explanation of an embodiment of an electrophotographic type printer (hereafter simply referred to as printer), as an image forming apparatus that applies the present invention.

Figure 1:
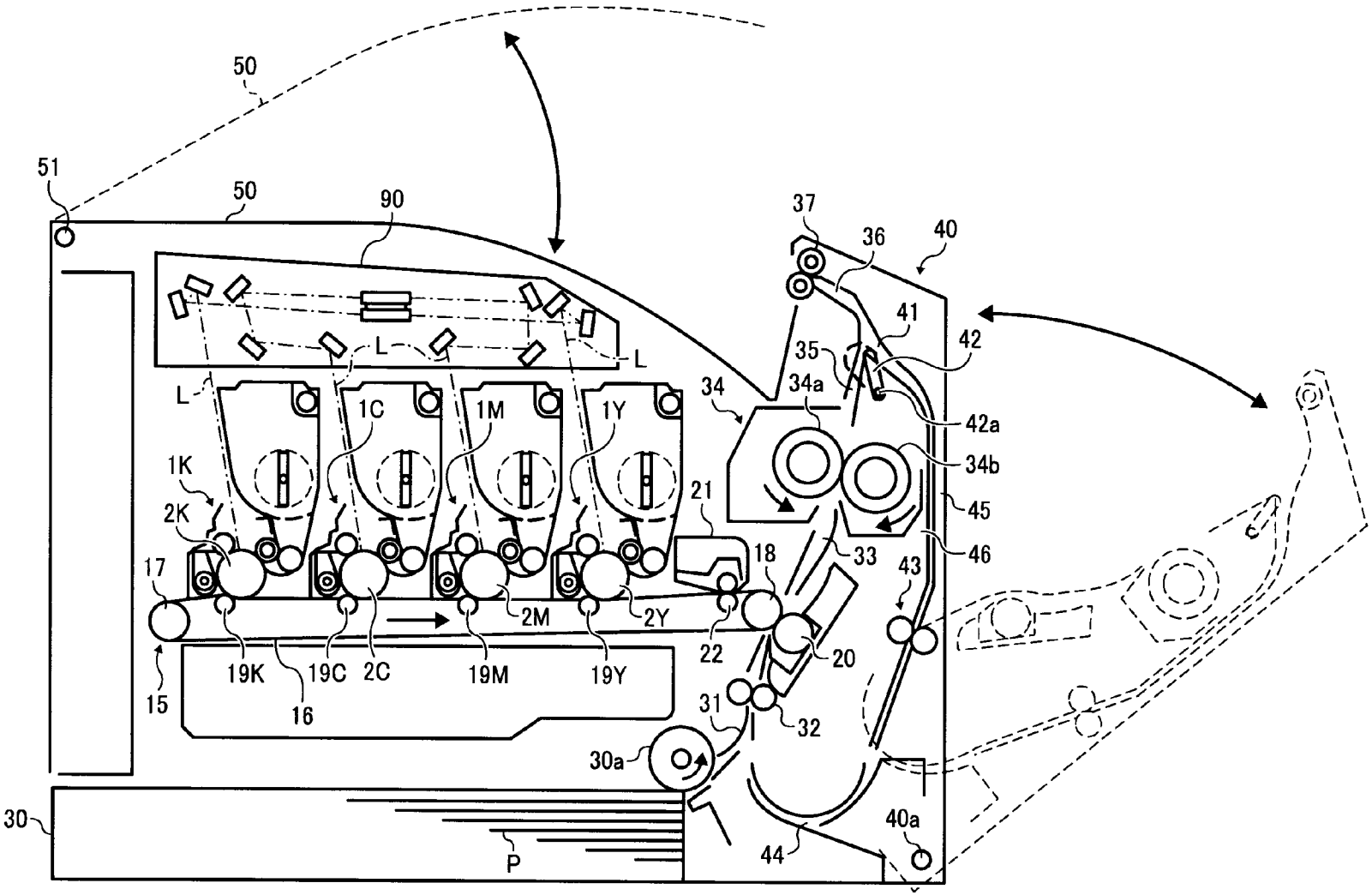
FIG. 1 is a diagram showing the outline configuration of a printer that uses a developing device according to an embodiment of the present invention.

First the basic configuration of the printer is explained. FIG. 1 shows the outline configuration of the printer. In FIG. 1, the printer includes four process units 1Y, M, C, K for forming toner images in the colors yellow, magenta, cyan, and black (hereafter indicated as Y, M, C, and K). The process units 1Y, M, C, K use Y, M, C, K toner respectively as developing agent, but otherwise have the same configuration. When the process units 1Y, M, C, K reach the end of their life, they are changed.

Figure 2:
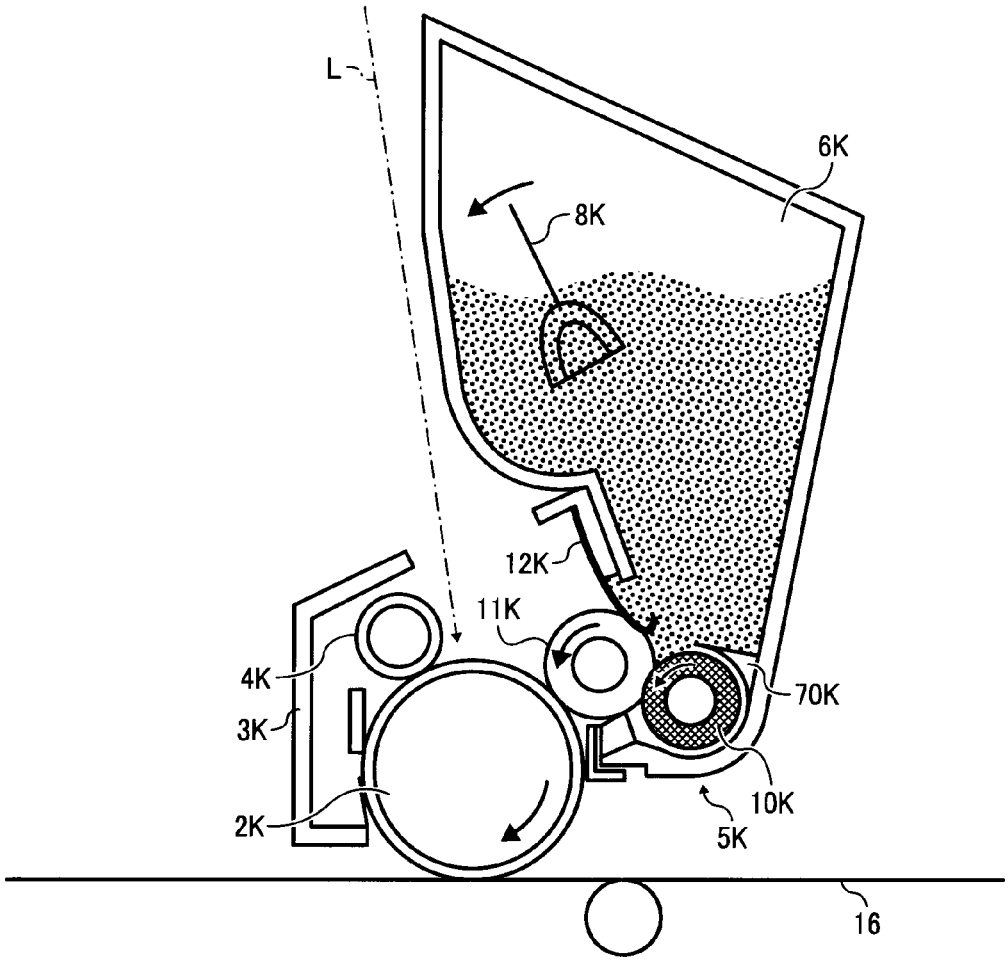
FIG. 2 is a diagram showing the outline configuration of a process unit that uses the same developing device.

FIG. 2 shows the outline configuration of a process unit that uses the developing device according to the present invention. Taking the process unit 1K for forming K toner images as an example, then as shown in FIG. 2, the process unit 1K includes a drum-shaped photosensitive member 2K as latent image carrier, a drum cleaning device 3K, a decharging device (not shown in the drawings), a charging roller 4K, a developing device 5K, and so on. The process unit 1K can be removed from and inserted into the main body of the printer, and can be changed in one operation as a worn out component.

The photosensitive member 2K is rotated by drive means, which is not shown in the drawings, in the clockwise direction shown in the drawings at a linear speed of 150 mm/sec. A high voltage is applied to the charging roller 4K by a high voltage power supply circuit, which is not shown in the drawings. Discharge occurs from the charging roller 4K towards the photosensitive member 2K at the portion where the rotating photosensitive member 2K is in opposition with the charging roller 4K. As a result of this discharge, the surface of the photosensitive member 2K is uniformly charged to −500V. Also, a K electrostatic latent image is formed on surface of the photosensitive member 2K by scanning with a light beam L. The K electrostatic latent image is developed into a K toner image by the developing device 5K using K toner, which is not shown in the drawings. Then the K toner image is transferred onto an intermediate transfer belt 16 in an intermediate transfer operation. The drum cleaning device 3K removes transfer residual toner adhering to the surface of the photosensitive member 2K after passing through the intermediate transfer operation, by wiping the surface of the photosensitive member 2K with a cleaning brush or cleaning blade, or the like.

The decharging device removes residual charge from the photosensitive member 2K after cleaning. As a result of the decharging, the surface of the photosensitive member 2K is initialized, in preparation for the next image forming operation. In the process units for the other colors (1Y, M, C) also, Y, M, C toner images are formed on the photosensitive members 2Y, M, C in the same way, and transferred onto the intermediate transfer belt 16, which is described later, in the intermediate transfer operation.

The developing device 5K includes a developing roller 11K provided in an aperture in the bottom of a tall hopper 6K that houses K toner, which is not shown in the drawings, a supply roller 10K disposed adjacent to the developing roller 11K, an agitator 8K that agitates the K toner, and so on.

The toner agitated by the agitator 8K in the hopper 6K is mixed with air to increase its fluidity, and moves to the vicinity of the supply roller 10K due to self weight.

Within the developing device 5K, the supply roller 10K as a developing agent body is provided and toner deposits on the supply roller 10K. The supply roller 10K is rotated in the counterclockwise direction by drive means, which is not shown in the drawings.

The developing roller 11K, which is a developing agent carrier, is disposed adjacent to the supply roller 10K. The developing roller 11K is rotated in the counterclockwise direction on the drawing by drive means, which is not shown on the drawings, while contacting the supply roller 10K and the photosensitive member 2K.

A developing bias, which is explained later, is applied to the developing roller 11K by a power supply circuit, which is not shown in the drawings. Also, a supply bias is applied to the supply roller 10K by a power supply circuit, which is not shown in the drawings. The relationship between the developing bias and the supply bias is a relationship that forms an electric field capable of causing electrostatic transfer of negatively charged toner from the supply roller 10K to the developing roller 11K. However, the direction of the electric field is not limited to this, and depending on the type of toner the direction may be the opposite, or there may be zero direction to electrostatically transfer the toner between the rollers. Toner deposited on the supply roller 10K is carried on the surface of the supply roller 10K. Then, as the supply roller 10K rotates, the toner is transported to the contact portion between the supply roller 10K and the developing roller 11K, where the toner is transferred to the surface of the developing roller 11K due to the electric field described above and the pressure in the contact portion. The toner carried on the surface of the developing roller 11K as a result of this transfer is transported by the rotation of the developing roller 11K, and passes the contact portion of the developing roller 11K with a layer thinning blade 12K.

A charging assistance bias is applied to the layer thinning blade 12K by a power supply circuit, which is not shown in the drawings. The relationship between the charging assistance bias and the developing bias is a relationship that forms an electric field capable of electrostatically transferring the negatively charged toner from the blade side to the developing roller 11K side. Toner that enters the contact portion between the developing roller 11K and the layer thinning blade 12K is urged towards the developing roller 11K by the electric field, and as the roller rotates, frictional charging is promoted by friction with the layer thinning blade 12K. At the same time, the layer thickness on the developing roller 11K is regulated.

The toner that has passed the contact portion between the developing roller 11K and the layer thinning blade 12K is transported by the rotation of the developing roller 11K to a developing nip where the developing roller 11K contacts the photosensitive member 2K. The relationship between the voltage of the electrostatic latent image of the photosensitive member 2K, the voltage of the base portion (uniformly charged voltage) of the photosensitive member 2K, and the developing bias is as follows. The relationship is such that an electric field is formed so that toner within the developing nip between the electrostatic latent image and the developing roller 11K is electrostatically transferred from the developing roller 11K side to the electrostatic latent image side. On the other hand toner between the base portion and the developing roller 11K is electrostatically transferred from the base portion side to the developing roller side. As a result of this relationship, toner on the surface of the developing roller 11K is selectively transferred to the electrostatic latent image Of the photosensitive member 2K. As a result of this transfer, the electrostatic latent image is developed into a K toner image.

The surface of the supply roller 10K has a cellular structure, made from a foam material whose electrical resistance is adjusted to the range $10^3$ through $10^{15}\Omega$. The toner transport efficiency is increased by carrying toner within the voids. Also, the voids have the function of minimizing degradation of the toner by the concentration of pressure at the contact portion with the developing roller 11K. Also, preferably undulating grooves are formed in the surface of the supply roller 10K. In this way, by making the supply roller 10K from an elastic material, such as a foam material or the like, it is possible to make the supply roller 10K contact the developing roller 11K with pressure. At this time the developing agent being carried by the supply roller 10K can be efficiently released by the elastic deformation, and the developing agent is supplied to the developing roller 11K. In addition, the elastic deformation becomes a driving force to fluidize the developing agent, so it is possible to fluidize the developing agent near the developing roller 11K, the regulating blade 12K, and the supply roller 10K. Therefore it is possible to prevent the increase in torque of the supply roller, image density unevenness, and supply roller wear.

Also, by increasing the rotation speed of the supply roller 10K to greater than 80 mm/s, it is possible to fluidize the developing agent near the developing roller 11K, the regulating blade 12K, and the supply roller 10K. Therefore it is possible to prevent stagnation and agglomeration of developing agent, and minimize the increase in torque of the supply roller 10K, image density unevenness, and wear in the supply roller 10K.

Also, on the surface of the developing roller 11K, a surface layer is formed from an elastic rubber having frictional charging characteristics of the opposite polarity to that of the toner. This surface layer is adjusted to a JIS-A hardness of 50° or less. Also, the surface roughness Ra is adjusted to be mainly within the range 0.2 through 2.0 μm, but the range 0.8 through 1.2 μm is particularly preferable. As a result of the surface layer with these characteristics, the developing agent transport properties of the developing roller 11K are optimized, and a uniform thickness of toner is formed on the developing roller 11K. Also, it is possible to fluidize the developing agent near the developing roller 11K, the regulating blade 12K, and the supply roller 10K, and minimize the increase in torque of the supply roller 10K, image density unevenness, and wear in the supply roller 10K.

The layer thinning blade 12K is a thin blade made from a metal such as SUS 304CSP, SUS 301CSP, phosphor bronze, or the like, and is pressed against the developing roller 11K with a force in the range 10 through 100 N/m.

The casing of the developing device 5K supports a cantilevered sealing film 13K, and a free end of the sealing film 13K contacts the developing roller 11K. The space enclosed by the developing roller 11K and the developing device 5K are partitioned by the sealing film 13K and the layer thinning blade 12K, so that leakage of toner from the developing device 5K is prevented. The K process unit in FIG. 2 was used for explanation, however by the same process the Y, M, and C process units 1Y, M, C form Y, M, and C toner images on the photosensitive members 2Y, M, C. In FIG. 1 as described previously, an optical writing unit 90 is disposed above the process units 1Y, M, C, K in the vertical direction. The optical writing unit 90, which is a latent image writing device, optically scans the photosensitive members 2Y, M, C, K in the process units 1Y, M, C, K with light beams L emitted from a laser diode or an LED diode, based on image information. As a result of this optical scanning, Y, M, C, K electrostatic latent images are formed on the photosensitive members 2Y, M, C, K. The optical writing unit 90 deflects the light beam L emitted from a light source in the main scan direction with a polygon mirror that is rotated by a polygon motor, which is not shown in the drawings, and illuminates the photosensitive member via a plurality of optical lenses and mirrors.

A transfer unit 15 in which the endless intermediate transfer belt 16 is tensioned and rotated endlessly in the counterclockwise direction in the drawings is disposed below the process units 1Y, M, C, K in the vertical direction. Besides the intermediate transfer belt 16, the transfer unit 15, which is transfer means, includes a drive roller 17, a driven roller18, four primary transfer rollers 19Y, M, C, K, a secondary transfer roller 20, a belt cleaning device 21, a cleaning back-up roller 22, and so on.

The intermediate transfer belt 16 is supported and tensioned by the drive roller 17, the driven roller 18, the cleaning back-up roller 22, and the four primary transfer rollers 19Y, M, C, K disposed within the inside of the loop. Also, the intermediate transfer belt 16 is endlessly rotated in the counterclockwise direction by the rotational force of the drive roller 17, which is rotated in the counterclockwise direction by drive means which is not shown in the drawings.

The four primary transfer rollers 19Y, M, C, K sandwich the intermediate transfer belt 16, which endlessly rotates in this way, between the photosensitive members 2Y, M, C, K. By being sandwiched in this way, Y, M, C, K primary transfer nips are formed by the contact of the outer surface of the intermediate transfer belt 16 with the photosensitive members 2Y, M, C, K.

Primary transfer biases are applied to the primary transfer rollers 19Y, M, C, K by a transfer bias power supply, which is not shown in the drawings. In this way, a transfer electric field is formed between the electrostatic latent images of the photosensitive members 2Y, M, C, K and the primary transfer rollers 19Y, M, C, K. Instead of the primary transfer rollers 19Y, M, C, K, transfer chargers or transfer brushes, or the like, may be used.

When the Y toner formed on the surface of the photosensitive member 2Y of the Y process unit 1Y enters the Y primary transfer nip as the photosensitive member 2Y rotates, primary transfer occurs from the photosensitive member 2Y to the intermediate transfer belt 16 due to the action of the transfer electric field and the nip pressure. The intermediate transfer belt 16 to which the Y toner image has been transferred in the primary transfer operation in this way passes through the M, C, K primary transfer nips due to the endless movement of the intermediate transfer belt 16. When passing through the M, C, K primary transfer nips the M, C, K toner images on the photosensitive members 2M, C, K are successively superimposed onto the Y toner image in the primary transfer operations. As a result of the superimposition in the primary transfer operation, a four color toner image is formed on the intermediate transfer belt 16.

The secondary transfer roller 20 of the transfer unit 15 is disposed to the outside of the loop of the intermediate transfer belt 16, sandwiching the intermediate transfer belt 16 between the driven roller 18 on the inside of the loop. As a result of being sandwiched in this way, a secondary transfer nip is formed where the outside surface of the intermediate transfer belt 16 contacts the secondary transfer roller 20. A secondary transfer bias is applied to the secondary transfer roller 20 by a transfer bias power supply, which is not shown in the drawings. As a result of this application, a secondary transfer electric field is formed between the secondary transfer roller 20 and the driven roller, which is connected to ground.

A sheet supply cassette 30 that houses a plurality of recording sheets P in the form of a stack of sheets is disposed below the transfer unit 15 in the vertical direction. The sheet supply cassette 30 can be removed from and inserted into the main body of the printer by sliding. A sheet supply roller 30*a* contacts the uppermost recording sheet P in the stack of sheets in the sheet supply cassette 30, and transmits the recording sheet P into a sheet supply path 31 by rotating in the counterclockwise direction in the drawings at predetermined timing.

A pair of registration rollers 32 is disposed near the end of the sheet supply path 31. As soon as the recording sheet P transmitted from the sheet supply cassette 30 is sandwiched between the pair of registration rollers 32, rotation of both rollers is stopped. Then, the rotation is re-started at a timing that synchronizes the sandwiched recording sheet P with the four color toner image on the intermediate transfer belt 16 in the secondary transfer nip, and the recording sheet P is transmitted into the secondary transfer nip.

At the secondary transfer nip, the four color toner image on the intermediate transfer belt 16 is brought into close contact with the recording sheet P. Then under the action of the secondary transfer electric field and the nip pressure the four color toner image is transferred onto the recording sheet P in one secondary transfer operation, so a full color toner image is formed on the recording sheet P in consonance with the white color of the recording sheet P. When the recording sheet P on whose surface the full color toner image has been formed in this way passes through the secondary transfer nip, it is separated by the curvature from the secondary transfer roller 20 and the intermediate transfer belt 16. Then the recording sheet P is transmitted to a fixing device 34, which is described later, via a post-transfer transport path 33.

After passing through the secondary transfer nip, transfer residual toner that was not transferred to the recording sheet P adheres to the intermediate transfer belt 16. This is cleaned from the surface of the belt by the belt cleaning device 21 which is in contact with the outside surface of the intermediate transfer belt 16. The cleaning back-up roller 22 disposed on the inside of the loop of the intermediate transfer belt 16 provides back-up to the cleaning of the belt by the belt cleaning device 21 from the inside of the loop.

The fixing device 34 forms a fixing nip with a fixing roller 34*a* and a pressure roller 34*b*. The fixing roller 34*a* contains a heat generating source, such as a halogen lamp, or the like. The pressure roller 34*b* contacts the fixing roller 34*a* with a predetermined pressure. The surface with the unfixed toner image of the recording sheet P transmitted to the fixing device 34 is brought into close contact with the fixing roller 34*a*, and sandwiched within the fixing nip. Then, the toner in the toner image is softened by the effect of the heat and pressure, and the full color image is fixed. After passing through a post-fixing transport path 35, the recording sheet P discharged from the fixing device 34 brought up to a branch point between a sheet discharge path 36 and a pre-reversal transport path 41. A switching claw 42 that can swivel about a swiveling shaft 42*a* is disposed to the side of the post-fixing transport path 35. The end portion of the post-fixing transport path 35 is closed or opened by the swiveling of the switching claw 42. At the timing that the recording sheet P is discharged from the fixing device 34, the switching claw 42 is stopped at the swivel position indicated on the drawing by the solid lines, and the end portion of the post-fixing transport path 35 is open. Therefore, the recording sheet P is transmitted from the post-fixing transport path 35 into the sheet discharge path 36, and becomes sandwiched between a pair of sheet discharge rollers 37.

When the single sided printing mode has been set by the input operation at an operation unit that includes a keyboard and so on, which is not shown in the drawings, or by control signals transmitted from a personal computer or the like, which is not shown in the drawings, the recording sheet P sandwiched by the pair of sheet discharge rollers 37 is discharged as it is from within the apparatus. Then the recording sheet P is stacked on the top surface of a top cover 50 of the main body.

On the other hand, when the double sided printing mode has been set, when the trailing edge of the recording sheet P has passed out of the post-fixing transport path 35 and into the sheet discharge path 36, while the leading edge is sandwiched by the pair of sheet discharge rollers 37, the switching claw 42 is swiveled to the position indicated by the chain dotted line in the drawing, and the end portion of the post-fixing transport path 35 is closed. Almost simultaneously the pair of sheet discharge rollers 37 start to rotate in the opposite direction. Then the recording sheet P is transported with the trailing edge forward, and transmitted into the pre-reversal transport path 41.

FIG. 1 shows the printer from the front side. The side to the front in the direction normal to the plane of the paper of the figure is the front surface, and to the rear is the rear surface. Also, the right side of the printer in the figure is the right surface, and the left side of the printer in the figure is the left surface. In the right end portion of the printer is a reversal unit 40 that is capable of opening and closing with respect to the main body by swiveling about a swiveling shaft 40a. When the pair of sheet discharge rollers 37 rotate in the reverse direction, the recording sheet P is transmitted into the pre-reversal transport path 41 of the reversal unit 40, and transported from the upper side to the lower side in the vertical direction. Then, after passing between a pair of reversal transport rollers 43, the recording sheet P is fed into a semi-circular shaped curved reversal transport path 44. Further, as the recording sheet P is transported along the curved shape, the top and bottom surfaces are reversed, and the direction of movement from top to bottom in the vertical direction is also reversed, and the recording sheet P is transported from bottom towards the top in the vertical direction. Then, the recording sheet P is again fed into the secondary transfer nip after passing through the sheet supply path 31. Then, after the full color image is transferred onto the other side in a single secondary transfer operation, the recording sheet P passes successively through the post-transfer transport path 33, the fixing device 34, the post-fixing transport path 35, the sheet discharge path 36, and the pair of sheet discharge rollers 37, and is discharged to the outside.

The reversal unit 40 includes an external cover 45 and a swiveling member 46. Specifically, the external cover 45 of the reversal unit 40 is supported by the swiveling shaft 40*a* provided in the main body of the printer so that the external cover 45 can swivel. As a result of swiveling in this way, the external cover 45 and the swiveling member 46 supported therein open with respect to the main body. As shown by the broken line in the drawing, when the external cover 45 and the swiveling member 46 supported therein are opened, the sheet supply path 31, the secondary transfer nip, the post-transfer transport path 33, the fixing nip, the post fixing transport path 35, and the sheet discharge path 36, which are formed between the reversal unit 40 and the main body side of the printer, are divided vertically in two, and exposed to the outside. In this way, paper jams within the sheet supply path 31, the secondary transfer nip, the post-transfer transport path 33, the fixing nip, the post fixing transport path 35, and the sheet discharge path 36 can be easily removed.

Also, the swiveling member 46 is supported by the external cover 45 so that when the external cover 45 is open, the swiveling member 46 can swivel about a swiveling shaft, which is not shown in the drawings, provided in the external cover 45. As a result of swiveling in this way, the swiveling member 46 opens with respect to the external cover 45, so the pre-reversal transport path 41 and the reversal transport path 44 are separated into two in the vertical direction and exposed to the outside. In this way, paper jams within the pre-reversal transport path 41 and the reversal transport path 44 can be easily removed.

The top cover 50 of the body of the printer is rotatably supported about a rotation shaft 51, so that the top cover 50 can freely swivel as indicated by the arrow symbol in the drawing. By rotating in the counterclockwise direction in the drawing, the top cover 50 is opened with respect to the main body. Also, the top aperture of the main body is greatly exposed to the outside. In this way, the optical writing unit 90 is exposed.

The format in which a plurality of process units 1Y, M, C, K is disposed in a straight line, and their respective toner images are formed and superimposed, as in the present printer, is known as the tandem format. In a tandem format printer, the overall size of the apparatus tends to become larger in the direction that the process units are aligned. Therefore, in the present printer, the expansion of the space in the direction of alignment of the units is minimized by giving the hoppers, which take up a particularly large amount of space in the process units, a shape that extends long in the direction normal to the direction of alignment of the units. However, in doing so, inevitably a configuration is adopted in which toner within the hopper falls down into the supply unit by self-weight. Then, in this configuration, toner enters the gap between the supply roller 10K and the opposing surface of the casing side wall, as shown in FIG. 2 for example, so agglomerated masses of toner can easily form.

Next, the characteristic configuration of the present printer is explained.

Figure 3:
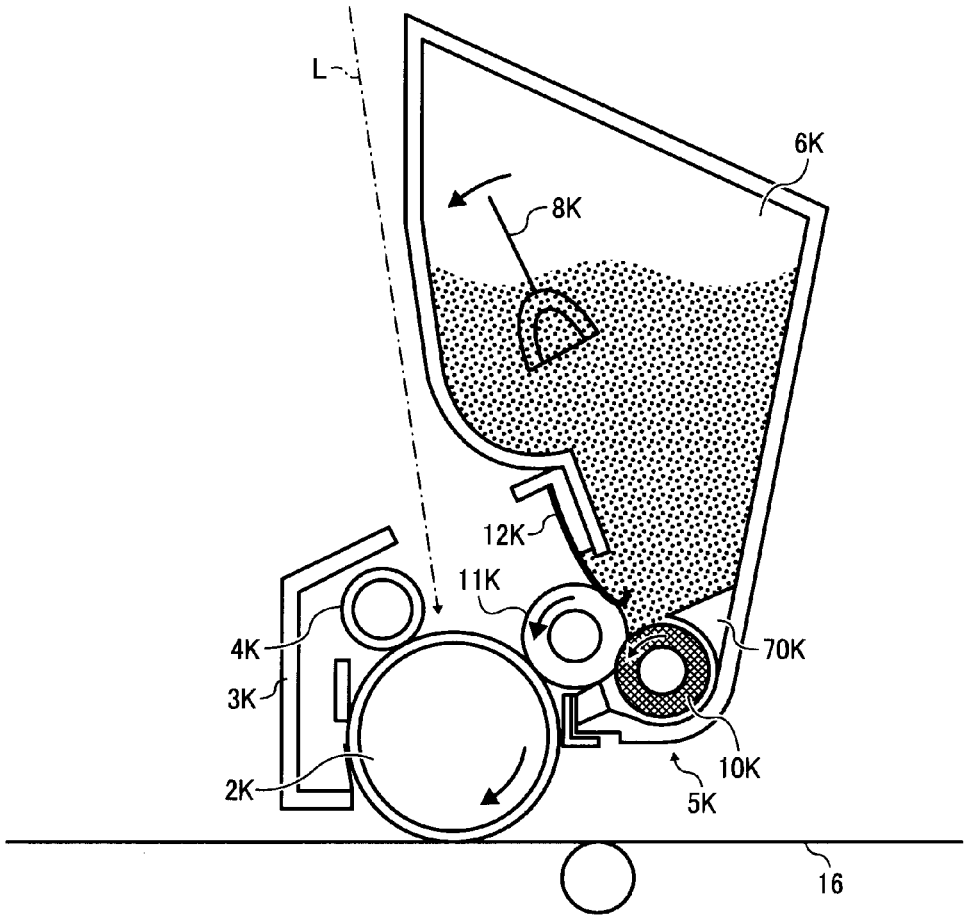
FIG. 3 is a diagram showing the outline configuration of a process unit that uses a developing device according to another embodiment of the present invention.
Figure 4:
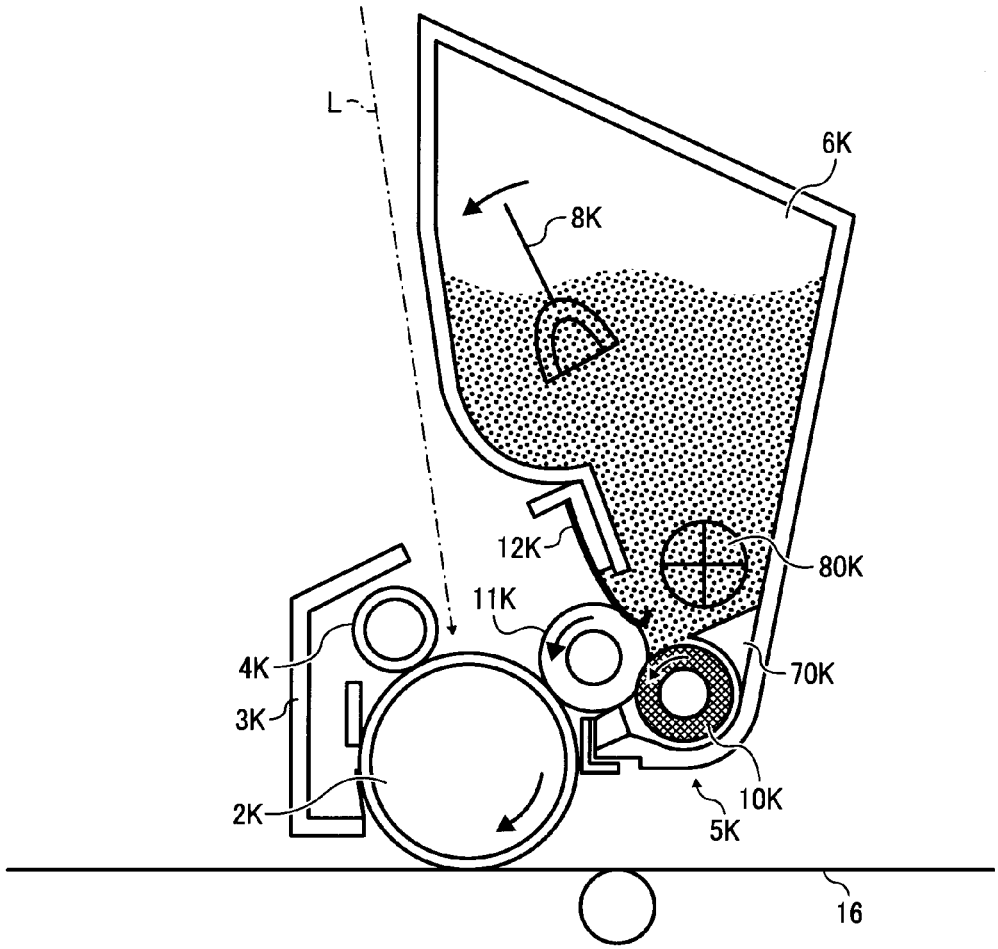
FIG. 4 is a diagram showing the outline configuration of a process unit that uses a developing device according to another embodiment of the present invention.

FIGS. 3 and 4 show the outline configuration of a process unit that use a developing device according to another embodiment of the present invention. In FIGS. 2, 3, and 4, the developing device 5K has a side wall in opposition to the peripheral surface of the supply roller 10K with a predetermined gap therebetween, but the opposing side wall supports a cantilevered protection member 70K. The protection member 70K, as developing agent ingress prevention member, is disposed directly above the gap between the supply roller 10K and the opposing side wall. The protection member 70K prevents toner that has dropped under self weight from above and deposited on the supply roller 10K from entering into the gap. Also, it is possible to create good toner circulation and maintain the fluidity of the toner by disposing the edge of the top surface of the protection member 70K that is close to the developing roller 11K, or the position of the surface of the protection member 70K to the side of the developing roller 11K, lower than the position of contact of the developing roller 11K with the layer thinning blade, and higher than the topmost position of the supply roller 10K. In this way, the increase in pressure of toner within the gap is reduced, so it becomes difficult to form agglomerated masses of toner. Also, the increase in torque of the supply roller 10K due to the formation of an agglomerated mass of toner in the gap, image density unevenness, and wear of the supply roller 10K is reduced.

By providing a slope on the protection member 70K as shown in FIG. 3, it is possible to prevent stagnation of toner on the protection member 70K, so it is possible to efficiently use the toner.

By providing a toner agitation member 80K above the protection member 70K extending in the direction of the roller axis of the supply roller 10K as shown in FIG. 4, it is possible to agitate the toner in the toner circulation path. Therefore it is possible to reduce the increase in pressure of the toner, and make the formation of agglomerated masses more difficult.

In this way it is possible to reduce the increase in torque of the supply roller 10K due to the formation of an agglomerated mass of toner in the gap, and image density unevenness and wear of the supply roller 10K is reduced. As a result of the configuration in which the protection member 70K, which is an ingress prevention member, is supported by cantilevering from the opposing side wall, it is possible to form the protection member 70K integrally with the developing device 5K, so the cost can be reduced.

The closest distance between the protection member 70K and the supply roller 10K is set larger than 0 mm and smaller than 5 mm. This is for a reason that is explained as follows. If the protection member 70K and the supply roller 10K contact (closest distance=0 mm), then even if tone that has stagnated in the gap between the supply roller 10K and the opposing side wall tries to exit from the gap by being carried on the surface of the supply roller 10K as the roller rotates, the toner will be removed by the protection member 70K. Therefore, the toner cannot be discharged from the gap by the rotation of the supply roller 10K, so the toner pressure within the gap gradually increases, so agglomeration of the toner increases. Also, as shown in FIG. 5, the results of tests by the inventors showed that when the closest distance is set to 5 mm or greater, the toner on the supply roller 10K positively enters the gap between the protection member 70K and the supply roller 10K due to gravity, so agglomeration occurs. By making the closest distance less than 5 mm, it is possible to prevent stagnation and blocking of the developing agent in the gap between the surface of the supply roller 10K and the protection member 70K, so it is possible to more reliably reduce the occurrence of agglomeration within the gap.

As shown in the drawings, the protection member 70K has a curved surface on the side in opposition to the supply roller 10K, with a curvature that conforms to the peripheral surface of the supply roller 10K. As a result of this configuration using the protection member 70K, wasted space formed between the supply roller 10K and the protection member 70K can be reduced. Furthermore, the configuration is simple, so it can be manufactured at low cost.

Figure 6:
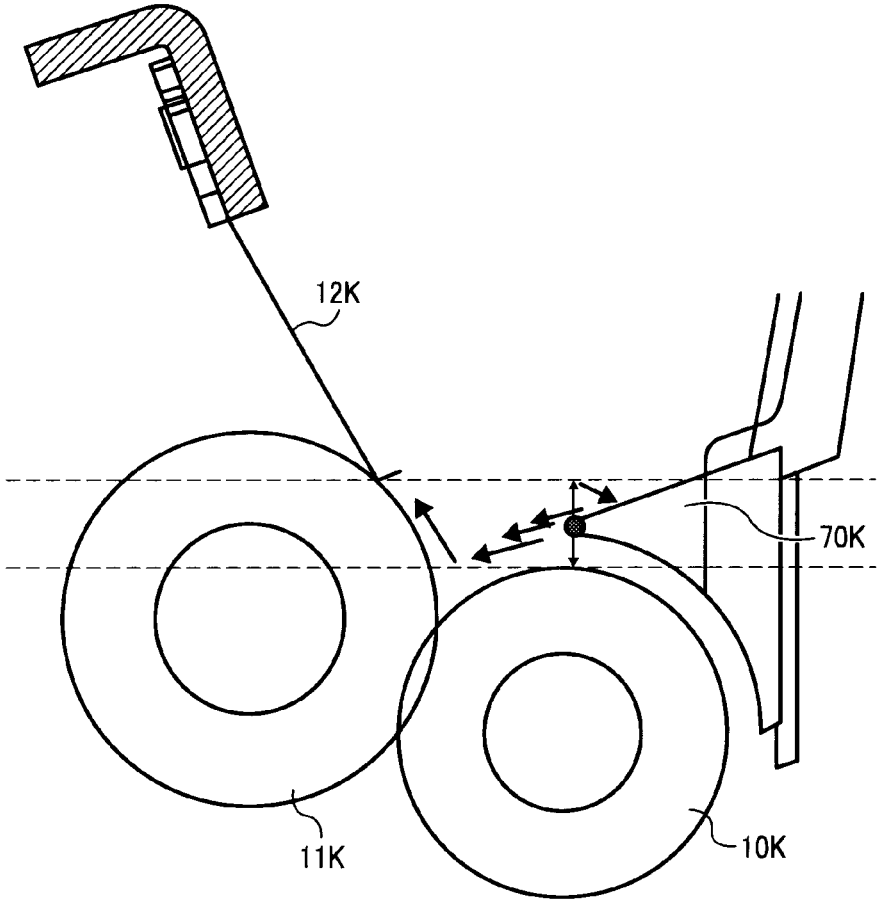
FIG. 6 is a diagram for explaining the state of supply of developing agent in a developing device using a protection member.
Figure 7:
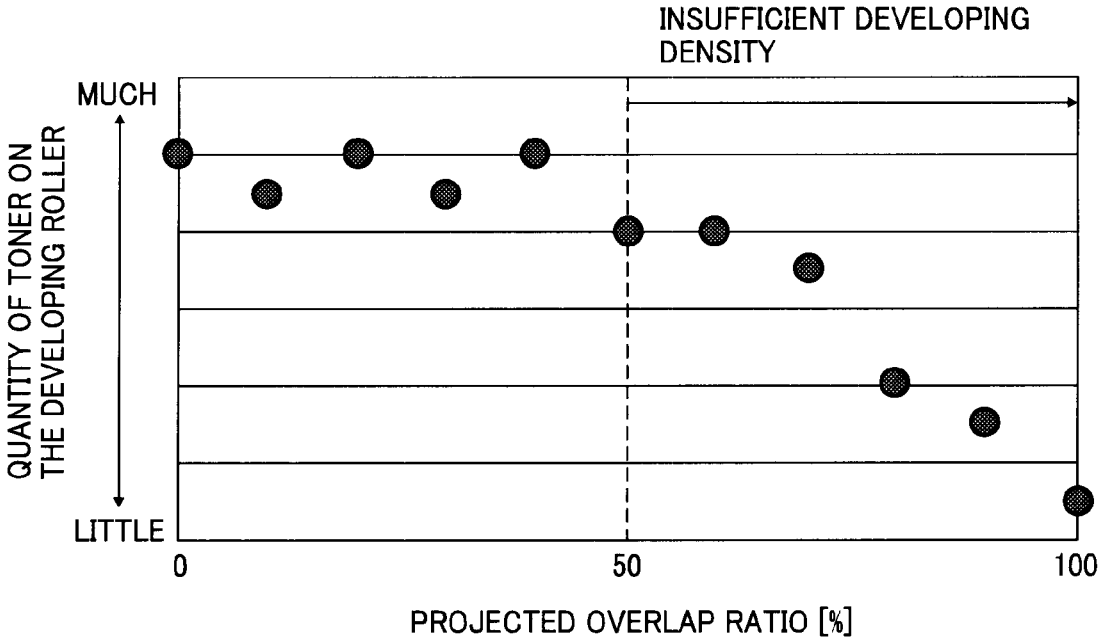
FIG. 7 is a graph showing the results of measurements of the quantity of toner per unit area on the surface of the developing roller 11K immediately after passing the contact position with the layer thinning blade 12K.

The inventors of the present invention prepared several different sizes of protection member 70K, and by changing them successively, varied the projected overlap ratio. The projected overlap ratio is the ratio of overlap of the projected surface in the vertical direction of the protection member 70K with respect to the projected surface in the vertical direction of the supply roller 10K. FIG. 6 is an outline diagram for explaining the state of supply of developing agent in a developing device that uses a protection member. Then, the developing device was operated at the respective projected overlap ratios, and the quantity of toner per unit area was measured on the surface of the developing roller 11K immediately after passing the position of contact with the layer thinning blade 12K. The results are shown as a graph in FIG. 7. In this graph, in the area to the right of the dotted line, there was insufficient developing density due to insufficient toner supply from the developing roller 11K to the photosensitive member 2K. Therefore, to reduce the insufficient developing density, it can be seen that it is necessary to overlap the projected surface in the vertical direction of the protection member 70K by less than half of the projected area in the vertical direction of the supply roller 10K.

Therefore, in the present printer, the projected surface in the vertical direction of the protection member 70K is overlapped with less than half the area of the projected area in the vertical direction of the supply roller 10K. With this configuration, a sufficient quantity of toner falling under self weight contacts the supply roller 10K, so it is possible to obtain images with sufficient density. As a result, by slanting the top surface of the protection member 70K with the end near the developing roller as the low side, stagnation of developing agent on the protection member 70K is prevented, so it is possible to efficiently use the developing agent. Also, by overlapping the projected surface in the vertical direction of the protection member 70K over less than half the area of the projected area in the vertical direction of the supply roller 10K, it is possible to ensure sufficient opportunity for contact between the supply roller 10K and the developing agent, so a sufficient quantity of toner can be supplied to the developing roller 11K.

Figure 8:
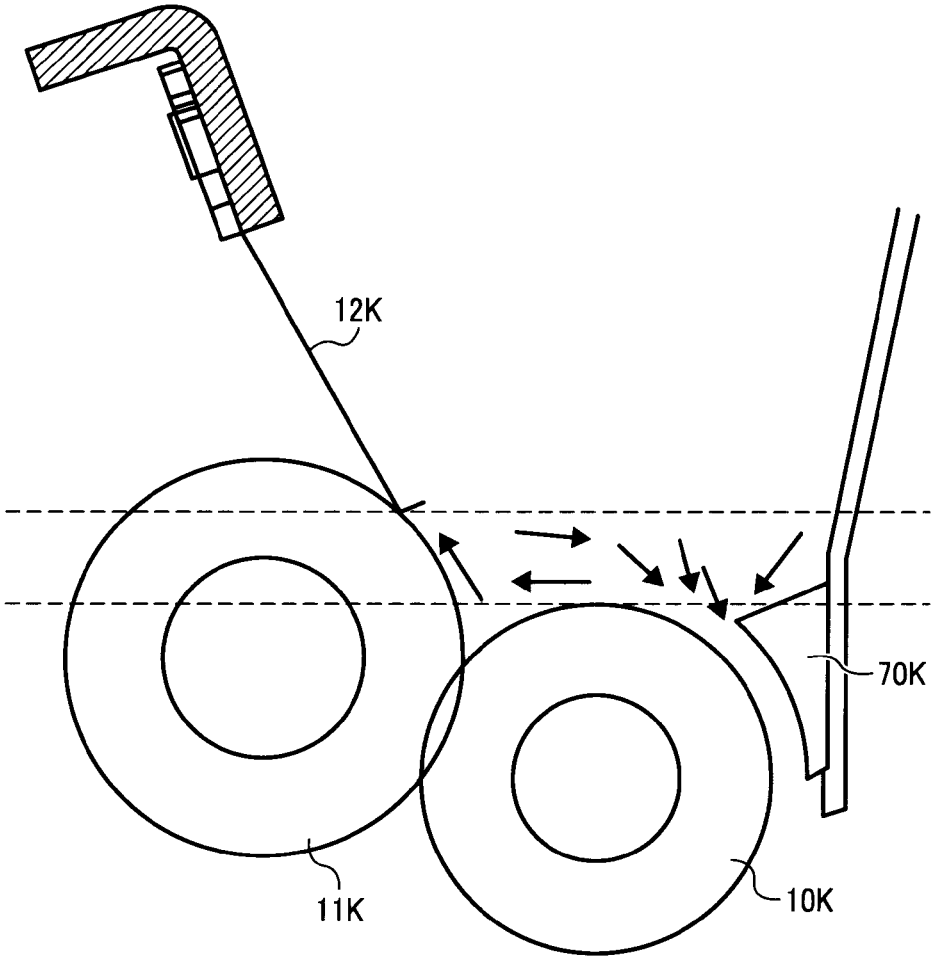
FIG. 8 is a diagram showing the outline configuration of a developing device in which the position of the surface of the protection member on the developing roller side is disposed below the highest point of the supply roller.

Also, as shown in FIG. 6, by disposing the edge of the top surface of the protection member 70K that is closest to the developing roller 11K, or the position of the surface of the protection member 70K to the side of the developing roller 11K, below the position of contact of the developing roller with the layer thinning blade, and above the topmost position of the supply roller 10K, it is possible to create a good circulation of toner and maintain the fluidity of the toner. FIG. 8 is an outline diagram showing the configuration of a developing device in which the position of the surface of the protection member to the side of the developing roller is disposed below the topmost point of the supply roller. However, as shown in FIG. 8, the edge of the top surface of the protection member 70K that is closest to the developing roller 11K, or the position of the surface of the protection member 70K to the side of the developing roller 11K is disposed below the position of contact of the developing roller with the layer thinning blade, and below the topmost position of the supply roller 10K. Therefore it can be seen that the supply of toner is insufficient.

Figure 9:
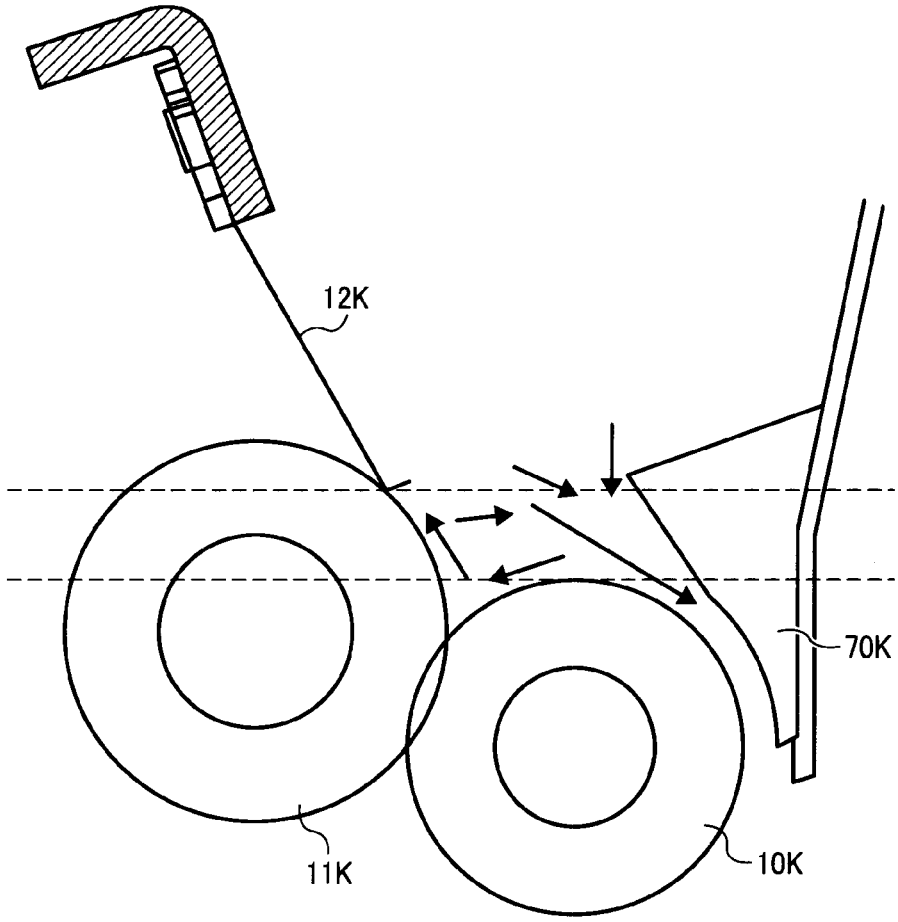
FIG. 9 is a diagram showing the outline configuration of a developing device in which the position of the surface of the protection member on the developing roller side is disposed higher than the position of contact of the developing roller and the layer thinning blade.

Also, FIG. 9 is an outline diagram showing the configuration of a developing device in which the position of the surface of the protection member to the side of the developing roller is disposed above the position of contact of the developing roller with the layer thinning blade. However, as shown in FIG. 9, the edge of the top surface of the protection member 70K that is closest to the developing roller 11K, or the position of the surface of the protection member 70K to the side of the developing roller 11K is disposed above the position of contact of the developing roller with the layer thinning blade, and above the topmost position of the supply roller 10K. Therefore the supply of toner is excessive, and agglomerated masses are easily formed.

In the present printer, toner having the following characteristics is housed in the hopper 6K. The toner is non-magnetic toner in the form of a plurality of toner particles that contain wax. The average volume particle diameter of the toner particles is within the range 6 through 10 μm. Also, the result of measuring the maximum tensile force using an Agrobot, manufactured by Hosokawa Micron Corporation, is less than 0.55N. By using toner in the form of a plurality of toner particles that contain wax as the toner, it is possible to achieve oil-less fixing with low temperature heating. Also, the inventors of the present invention discovered by tests that when the measured value of the maximum tensile force is 0.55N or more, agglomeration of toner in the gap can rapidly and easily start. Therefore, by using toner for which the measured result of the maximum tensile force is less than 0.55N, it is possible to more positively reduce the formation of an agglomerated mass of developing agent in the gap, and prevent agglomeration of the developing agent. Therefore it is possible to reduce the increase in torque of the supply roller 10K, image density unevenness, and wear of the supply roller.

The configuration of the K developing device 5K has been explained using FIGS. 2, 3, and 4. However, the Y, M, and C developing devices have the same configuration.

A printer in which toner images with different colors are formed by a plurality of process units has been explained. However, the present invention may also be applied to an image forming apparatus provided with only one photosensitive member.

In the printer according to the present embodiment, the protection member 70K, which is an ingress prevention member, is supported cantilevered from the opposing side wall. Therefore it is possible to integrally form the protection member 70K and the developing device 5K, so it is possible to reduce the cost.

In the developing device according to the present invention as described above, by disposing the developing agent ingress prevention member lower than the regulating nip and higher than the supply roller, it is possible to ensure a good circulation of developing agent. Therefore, of the developing agent transported to the regulating nip by the rotation of the developing roller, the developing agent that cannot pass the regulating nip is thrown back and temporarily returns to the developing agent ingress prevention member. As a result, it is possible to prevent the formation of agglomerated masses of developing agent, and reduce the increase in the torque of the supply roller, image density unevenness, and wear of the supply roller.

Also, in the process cartridge according to the present invention, by including at least a latent image carrier in the process cartridge, it is easy to insert or remove the process cartridge into and from the main body of the image forming apparatus. Therefore user maintenance is made easier. Also, good images can be continuously output from the image forming apparatus according to the present invention.

Various modifications will become possible for those skilled in the art after receiving the teachings of the present disclosure without departing from the scope thereof.

What is claimed is:

1. A developing device, comprising:

a developing agent housing chamber which houses a non-magnetic one component developing agent, and which extends in a vertical direction, and has an aperture, in a lower portion thereof, that is in opposition to an image carrier that forms an electrostatic latent image;

a developing roller which is provided in the aperture and whose peripheral surface is partly exposed from the aperture to form a developing portion with the image carrier, and which carries the non-magnetic one component developing agent on the surface of the developing roller and transports the developing agent by rotation from the developing agent housing chamber to the developing portion, in order to develop on the developing portion, the electrostatic latent image of the image carrier;

a regulating blade, which is disposed higher than the center of rotation of the developing roller and is disposed to contact the surface of the developing roller in the vicinity of the aperture on an upstream side of the developing portion, in a transport direction of the developing roller, and which regulates a thickness of the non-magnetic one component developing agent transported on the developing roller;

a supply roller which is disposed within the developing agent housing chamber to pressure-contact the developing roller on the upstream side with respect to the regulating blade in the transport direction of the developing roller, and which supplies the non-magnetic one component developing agent within the developing agent housing chamber to the surface of the developing roller;

an agitator which is disposed higher than the developing roller, the regulating blade, and the supply roller, and which agitates the non-magnetic one component developing agent within the developing agent housing chamber; and a developing agent ingress prevention member disposed higher than the supply roller, and lower than the agitator, wherein a side surface or edge portion of the developing agent ingress prevention member in the vicinity of the developing roller is higher than the topmost point of the supply roller, and lower than the lowermost point of a regulating nip formed by the contact of the developing roller and the regulating blade, and the closest distance from the supply roller to a bottom surface of the developing agent ingress prevention member is greater than 0mm and less than 5mm.

2. The developing device as claimed in claim 1, wherein the developing agent ingress prevention member is supported cantilevered from an opposing side wall.

3. The developing device as claimed in claim 1, wherein a top surface of the developing agent ingress prevention member is sloping so that the side near the developing roller is lower.

4. The developing device as claimed in claim 1, wherein a projection surface in a vertical direction of the developing agent ingress prevention member overlaps less than half the area of a projection surface in a vertical direction of the supply roller.

5. The developing device as claimed in claim 1, wherein the supply roller is configured such that a metal core is covered by an elastic member.

6. The developing device as claimed in claim 1, wherein undulations are provided on the surface of the supply roller.

7. The developing device as claimed in claim 1, wherein the surface of the supply roller has pores.

8. The developing device as claimed in claim 1, wherein a peripheral speed of rotation of the supply roller is faster than 80mm/s.

9. The developing device as claimed in claim 1, further comprising a developing agent agitation member disposed above the developing agent ingress prevention member to extend in a direction of an axis of the supply roller.

10. The developing device as claimed in claim 1, wherein a surface roughness of the developing roller Ra is 0.8 or greater and 1.2 or less.

11. A process unit in an image forming apparatus having a latent image carrier that carries a latent image and a developing device that develops the latent image on the latent image carrier, the process unit comprising at least the latent image carrier and developing device held in a supporting member to be inserted into and removed from a main body of the image forming apparatus, wherein the developing device comprises:

a developing agent housing chamber which houses a non-magnetic one component developing agent, and which extends in a vertical direction, and has an aperture, in a lower portion thereof, that is in opposition to an image carrier that forms an electrostatic latent image;

a developing roller which is provided in the aperture and whose peripheral surface is partly exposed from the aperture to form a developing portion with the image carrier, and which carries the non-magnetic one component developing agent on the surface of the developing roller and transports the developing agent by rotation from the developing agent housing chamber to the developing portion, in order to develop on the developing portion, the electrostatic latent image of the image carrier;

a regulating blade, which is disposed higher than the center of rotation of the developing roller and is disposed to contact the surface of the developing roller in the vicinity of the aperture on an upstream side of the developing portion, in a transport direction of the developing roller, and which regulates a thickness of the non-magnetic one component developing agent transported on the developing roller;

a supply roller which is disposed within the developing agent housing chamber to pressure-contact the developing roller on the upstream side with respect to the regulating blade in the transport direction of the developing roller, and which supplies the non-magnetic one component developing agent within the developing agent housing chamber to the surface of the developing roller;

an agitator which is disposed higher than the developing roller, the regulating blade, and the supply roller, and which agitates the non-magnetic one component developing agent within the developing agent housing chamber; and a developing agent ingress prevention member disposed higher than the supply roller, and lower than the agitator, wherein a side surface or edge portion of the developing agent ingress prevention member in the vicinity of the developing roller is higher than the topmost point of the supply roller, and lower than the lowermost point of a regulating nip formed by the contact of the developing roller and the regulating blade, wherein the closest distance from the supply roller to a bottom surface of the developing agent ingress prevention member is greater than 0mm and less than 5mm.

12. An image forming apparatus, comprising:

a latent image carrier that carries a latent image; and a developing device that develops a latent image on the latent image carrier, wherein the developing device comprises:

a developing agent housing chamber which houses a non-magnetic one component developing agent, and which extends in a vertical direction, and has an aperture, in a lower portion thereof, that is in opposition to an image carrier that forms an electrostatic latent image;

a developing roller which is provided in the aperture and whose peripheral surface is partly exposed from the aperture to form a developing portion with the image carrier, and which carries the non-magnetic one component developing agent on the surface of the developing roller and transports the developing agent by rotation from the developing agent housing chamber to the developing portion, in order to develop on the developing portion, the electrostatic latent image of the image carrier;

a regulating blade, which is disposed higher than the center of rotation of the developing roller and is disposed to contact the surface of the developing roller in the vicinity of the aperture on an upstream side of the developing portion, in a transport direction of the developing roller, and which regulates a thickness of the non-magnetic one component developing agent transported on the developing roller;

a supply roller which is disposed within the developing agent housing chamber to pressure-contact the developing roller on the upstream side with respect to the regulating blade in the transport direction of the developing roller, and which supplies the non-magnetic one component developing agent within the developing agent housing chamber to the surface of the developing roller;

an agitator which is disposed higher than the developing roller, the regulating blade, and the supply roller, and which agitates the non-magnetic one component developing agent within the developing agent housing chamber; and a developing agent ingress prevention member disposed higher than the supply roller, and lower than the agitator, wherein a side surface or edge portion of the developing agent ingress prevention member in the vicinity of the developing roller is higher than the topmost point of the supply roller, and lower than the lowermost point of a regulating nip formed by the contact of the developing roller and the regulating blade, wherein the closest distance from the supply roller to a bottom surface of the developing agent ingress prevention member is greater than 0mm and less than 5mm.

* * * * *

UNITED STATES PATENT AND TRADEMARK OFFICE

CERTIFICATE OF CORRECTION

PATENT NO. : 7,890,033 B2
APPLICATION NO. : 11/965198
DATED : February 15, 2011
INVENTOR(S) : Shin Murayama et al.

It is certified that error appears in the above-identified patent and that said Letters Patent is hereby corrected as shown below:

On the title page, Item (54), and column 1, the title is incorrect. Item (54) and column 1 should read:

-- (54) DEVELOPING DEVICE, PROCESS UNIT, AND IMAGE FORMING APPARATUS WHICH PREVENTS INGRESS OF THE DEVELOPING AGENT IN THE VICINITY OF THE DEVELOPING ROLLER --

Signed and Sealed this
Twenty-eighth Day of June, 2011

David J. Kappos

David J. Kappos
*Director of the United States Patent and Trademark Office*